US011986112B2

(12) United States Patent
Hills et al.

(10) Patent No.: US 11,986,112 B2
(45) Date of Patent: May 21, 2024

(54) FOOTWEAR DONNING APPARATUS

(71) Applicant: United States Government as Represented by the Department of Veterans Affairs, Washington, DC (US)

(72) Inventors: Seth R. Hills, Richmond, VA (US); Garrett S. Bullock, Tuscaloosa, AL (US)

(73) Assignee: United States Government As Represented By The Department Of Veterans Affairs, Washington, DC (US)

( * ) Notice: Subject to any disclaimer, the term of this patent is extended or adjusted under 35 U.S.C. 154(b) by 0 days.

(21) Appl. No.: 17/354,576

(22) Filed: Jun. 22, 2021

(65) Prior Publication Data

US 2021/0393062 A1 Dec. 23, 2021

Related U.S. Application Data

(60) Provisional application No. 63/042,272, filed on Jun. 22, 2020.

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/82; A43B 11/02
USPC ..... 223/113, 118
See application file for complete search history.

(56) References Cited

U.S. PATENT DOCUMENTS

| | | | | | |
|---|---|---|---|---|---|
| 19,284 | A * | 2/1858 | Allender | A47G 25/82 | 223/119 |
| 33,456 | A * | 10/1861 | Worden | A47G 25/82 | 223/118 |
| 396,411 | A * | 1/1889 | McKenty | A47G 25/82 | 223/119 |
| 1,139,144 | A * | 5/1915 | Thomas | A47G 25/80 | 223/113 |
| 2,319,356 | A * | 5/1943 | Sullivan | A43B 23/08 | 36/DIG. 1 |
| 5,655,693 | A * | 8/1997 | Engelman | A47G 25/82 | 223/118 |

(Continued)

FOREIGN PATENT DOCUMENTS

DE 9415182 U1 * 3/1995

OTHER PUBLICATIONS

Amazon Listing for Shoe Horn Funnel with first available date Sep. 18, 2017, retrieved at https://www.amazon.com/Funnel-Hands-Free-Adaptive-Dressing-Shoehorn/dp/B075DH131H/ on Jun. 28, 2022 (Year: 2017).*

*Primary Examiner* — F Griffin Hall
(74) *Attorney, Agent, or Firm* — Ballard Spahr LLP

(57) ABSTRACT

An apparatus can be used for assisting a user in donning a shoe, the shoe having a heel collar and a tongue, wherein the tongue has an underside. The apparatus can comprise a body that is partially receivable into the shoe. The body can have a top portion that is configured to extend above the heel collar when the body is partially received into the shoe. An inner portion can extend downwardly from the top portion. First and second projections that extend forwardly from the body and can be configured to bias against the underside of the tongue on opposing sides of the tongue.

18 Claims, 7 Drawing Sheets

(56) References Cited

U.S. PATENT DOCUMENTS

| | | | | |
|---|---|---|---|---|
| 6,880,272 | B2 * | 4/2005 | Wells | A43B 11/02 36/105 |
| 7,090,101 | B2 * | 8/2006 | Engelman | A47G 25/80 223/113 |
| 2021/0353084 | A1 * | 11/2021 | Leon | A47G 25/82 |

* cited by examiner

FOOTWEAR DONNING APPARATUS

CROSS-REFERENCE TO RELATED APPLICATIONS

This application claims priority to and the benefit of the filing date of U.S. Provisional Patent Application No. 63/042,272, filed Jun. 22, 2020, the entirety of which is hereby incorporated by reference herein.

FIELD

This application relates to apparatuses that assist users with donning footwear.

BACKGROUND

Individuals can often benefit from apparatuses that assist with putting shoes on. For example, shoe horns are widely used for this purpose. However, shoe horns require flexibility, dexterity, strength, and sensation that some individuals can lack. One apparatus, sold under the trademark FOOT FUNNEL, is disclosed in U.S. Pat. No. 7,090,101, granted Aug. 15, 2006, and which is hereby incorporated by reference herein in its entirety, attempts to address some of the deficiencies of shoe horns. However, many individuals require additional help with shoe donning beyond what is afforded by the FOOT FUNNEL apparatus. Such individuals can include post-hip surgery populations and those with a comorbidity of excessive body weight/girth such that they cannot see or reach their feet.

SUMMARY

Disclosed herein, in one aspect, is an apparatus for assisting a user in donning a shoe, the shoe having a heel collar and a tongue, wherein the tongue has an underside. The apparatus can comprise a body that is partially receivable into the shoe. The body can have a top portion that is configured to extend above the heel collar when the body is partially received into the shoe. An inner portion can extend downwardly from the top portion. First and second projections that extend forwardly from the body can be configured to bias against the underside of the tongue on opposing sides of the tongue.

A method of using the apparatus can comprise inserting at least a portion of the apparatus into the shoe so that the first and second projecting portions bias against the underside of the tongue and positioning the body so that the heel collar is received between the outer portion and the inner portion of the body.

The method can further comprise inserting a foot into the shoe and removing the apparatus from the shoe.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION

Figure 1:
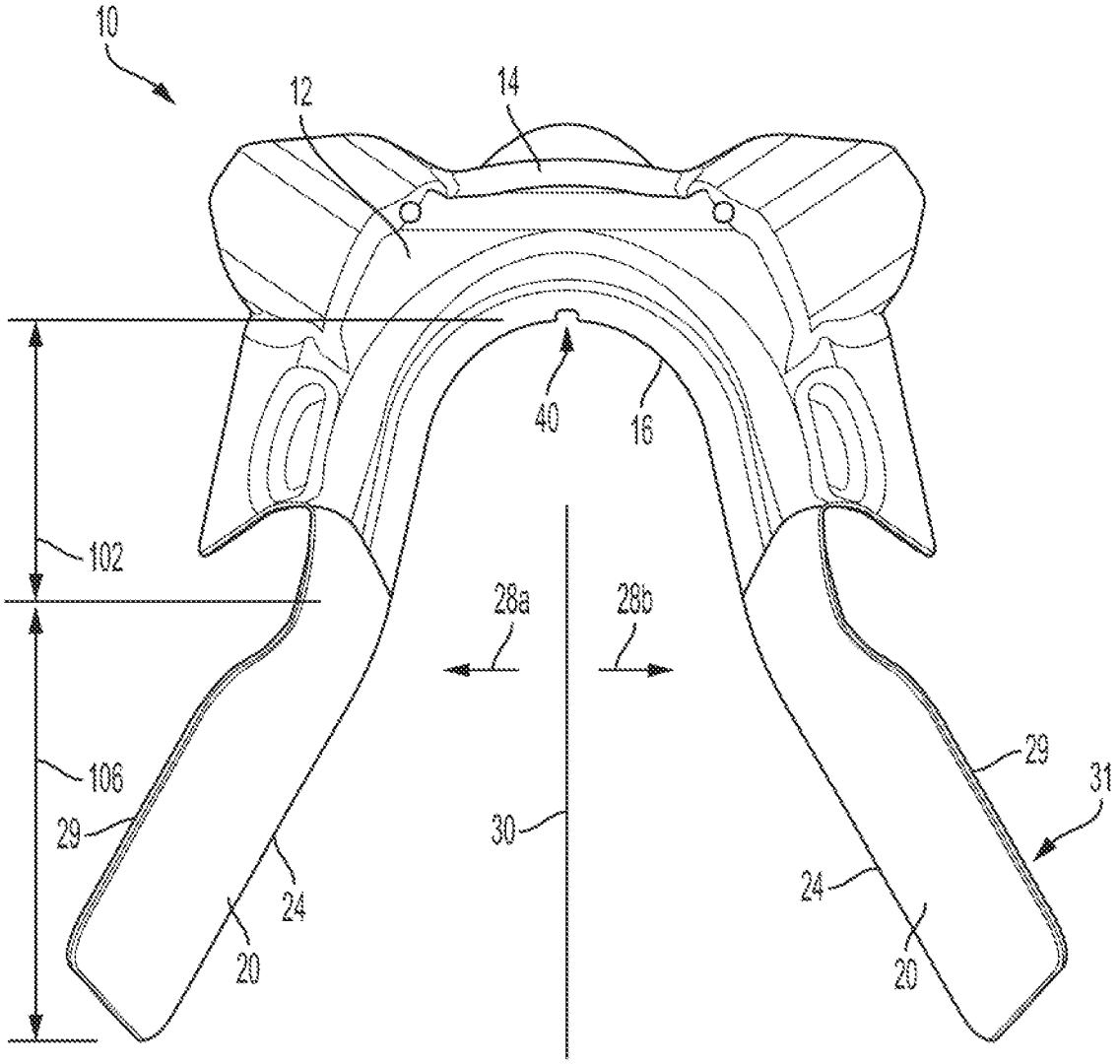
FIG. 1 is a front perspective view of an exemplary shoe donning apparatus in accordance with embodiments disclosed herein.

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

It must be noted that as used herein and in the appended claims, the singular forms "a," "an," and "the" include plural references unless the context clearly dictates otherwise. Thus, for example, reference to "a gripping element" includes one or more of such gripping elements, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification. Thus, words denoting order, such as "first" or "next," should be interpreted as optional aspects unless plain meaning or logic dictates otherwise.

Disclosed herein, in various aspects and with reference to FIGS. 1-4, is a shoe donning apparatus 10 for assisting a wearer (also referred to herein as a user) with donning a shoe 2 having a heel collar 4 and a tongue 6. The tongue 6 of the shoe 2 can have an underside 8 and opposing sides 7*a* and 7*b*. The heel collar 4 and tongue 6 can cooperate to define an opening 9 for receiving the wearer's foot. The apparatus can be configured to maintain the tongue of the shoe in a raised position (and maintain the opening 9 sufficiently open) so that the user's foot does not drive the tongue within the shoe during insertion of the user's foot into the opening. The apparatus 10 can have a body 12 that is at least partially receivable into the shoe. In some aspects, the body 12 can have a top portion 14 that is configured to engage and/or extend above the heel collar 4 when the body 12 is partially received into the shoe 2. An inner portion 16 can extend downwardly from the top portion 14 and be positioned within the opening of the shoe. Optionally, the inner portion 16 can engage at least a portion of the inner surface of the shoe.

In some optional aspects, an outer portion 18 can extend downwardly from the top portion 14. In such aspects, it is contemplated that the outer portion 18 and the inner portion 16 can be configured to cooperatively receive at least a portion of the heel collar 4 between the inner portion and the outer portion. For example, the inner portion 16 can be received within the shoe, the outer portion 18 can be positioned outside the shoe, and the top portion 14 can overlie (optionally, rest on or engage) the heel collar 4. In some optional aspects, and with reference to FIG. 1, the inner portion 16 of the body 12 can be about three inches wide and extend forwardly (i.e., have a forwardly extending dimension 102 of) about three inches. More generally, it is contemplated that the inner portion 16 can have a width that is equal or substantially equal to the forwardly extending dimension of the inner portion. In some optional aspects, and with reference to FIG. 3, the outer portion 18 of the body 12 can extend forwardly (i.e., have a forwardly extending dimension 104 of) about 3.5 inches and have a width (perpendicular to the forwardly extending dimension) of about 5.3 inches. More generally, it is contemplated that the outer portion 18 can have a width that is greater than the forwardly extending dimension of the outer portion by at least 20%, at least 30%, or at least 40%. Optionally, the inner portion 16 can extend downwardly from the top portion 14 by at least one inch (e.g., about 2 inches), and the outer portion 18 can extend downwardly from the top portion 14 by at least one inch (e.g., about 2.25 inches). More generally, it is contemplated that the outer portion 18 can extend downwardly by a first distance, and the inner portion 16 can extend downwardly by a second distance that is less than the first distance. It is contemplated that the body 12 can, when resting on the heel collar 4, be positioned rearward of, and offset from, the tongue 6 of the shoe 2.

In some optional aspects, the body 12 can be U-shaped or generally U-shaped. In this way, the body 12 can be configured to have a shape that matches (e.g., generally traces) at least a portion of a profile defined by an upper surface or edge of the heel collar 4. In this way, when the device 10 is inserted into the shoe, the top portion 14 of the body 12 can overlie (and, optionally, rest on) a top surface of the heel collar 4, the inner portion 16 of the body 12 can be positioned inside the shoe (and, optionally, bias against an inside surface of the shoe), and the outer portion 18 of the body 12 can surround (and, optionally, bias against) a portion of an outer surface of the shoe.

First and second projections 20 can extend forwardly from the body 12 (in a direction toward the toe portion of the shoe when in use) on opposing lateral sides of the body. When the body 12 is positioned so that the interior portion 16 is within the shoe and the top portion 14 is resting on the heel collar, the first and second projections 20 can be configured to bias against the underside of the tongue 6 to maintain the tongue in an elevated position, thereby holding the shoe opening 9 sufficiently open to receive the user's foot. Thus, it is contemplated that the first and second projections 20 can have a length sufficient to extend forwardly to a position beneath the tongue 6. For example, the forward projections can extend at least five inches, at least six inches, or at least seven inches from the rearmost point of the top portion 14 of the body 12. In some aspects, it is contemplated that the first and second projections 20 can extend forwardly of the heel collar when the apparatus is in a use position (with the projections 20 within the shoe 2 and the top portion 14 of the body 12 resting on the heel collar 4 of the shoe). In some aspects, the first and second projections 20 can be flexible and resilient. For example, in some aspects, the first and second projections 20 can comprise a polymer (e.g., a thermoplastic polymer). When the apparatus is placed on a level surface, the first and second projections 20, when unbent, can extend upwardly above the top portion 14 of the body 12 (e.g., by about one centimeter, less than one centimeter, or greater than one centimeter).

In some optional aspects, the first and second projections 20 can extend parallel or generally parallel to each other. In further aspects, the first and second projections 20 can diverge (have an increased spacing) in a forward direction (toward their respective distal ends). It is contemplated that the first and second projections 20 can be formed of a flexible resilient material so that they can be bent toward each other as they are inserted into the shoe so that outer surfaces of the first and second projections bias against the inner surfaces of the shoe. In still further optional aspects, the first and second projections 20 can be converging (with decreased spacing) in the forward direction.

Figure 2:
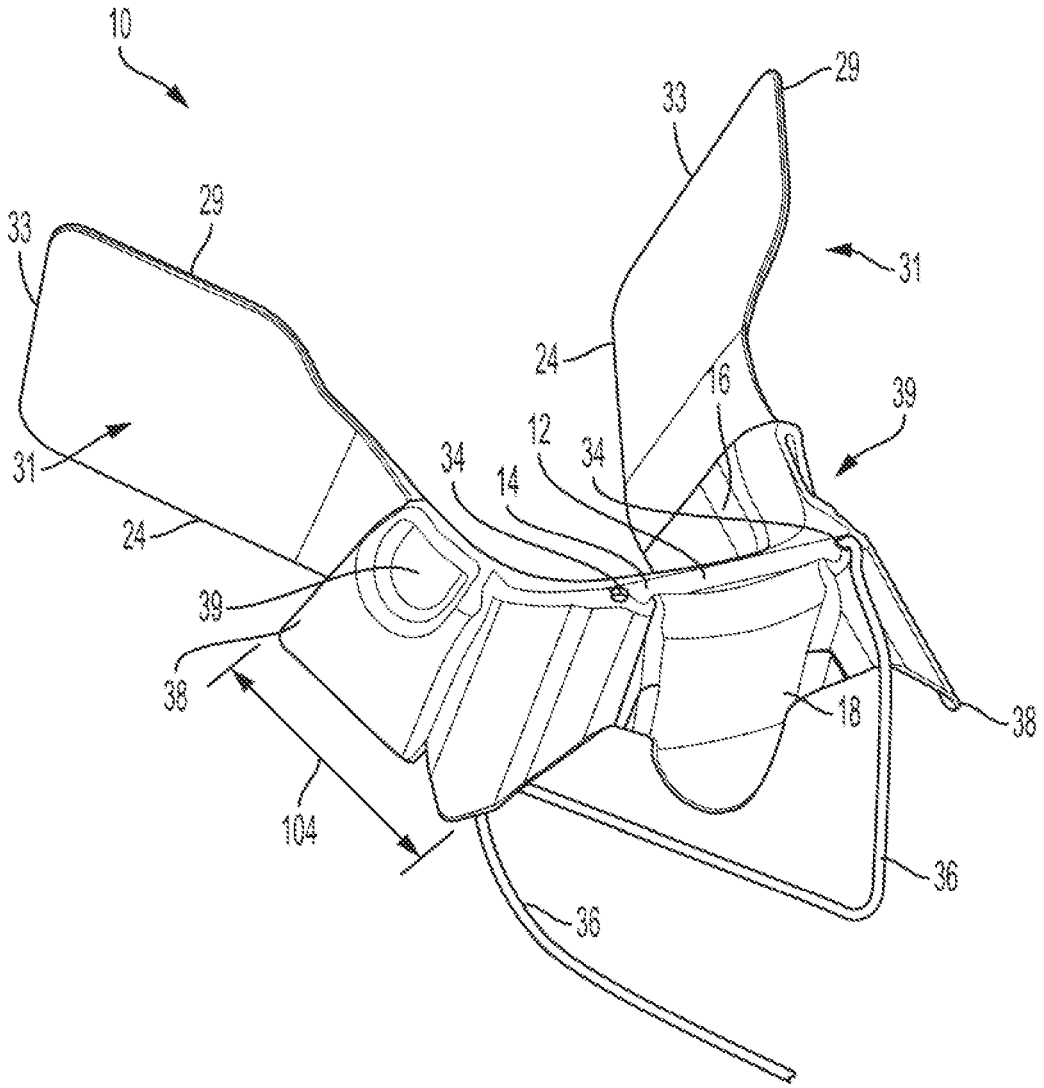
FIG. 2 is a rear perspective view of the shoe donning apparatus as in FIG. 1.
Figure 3A:
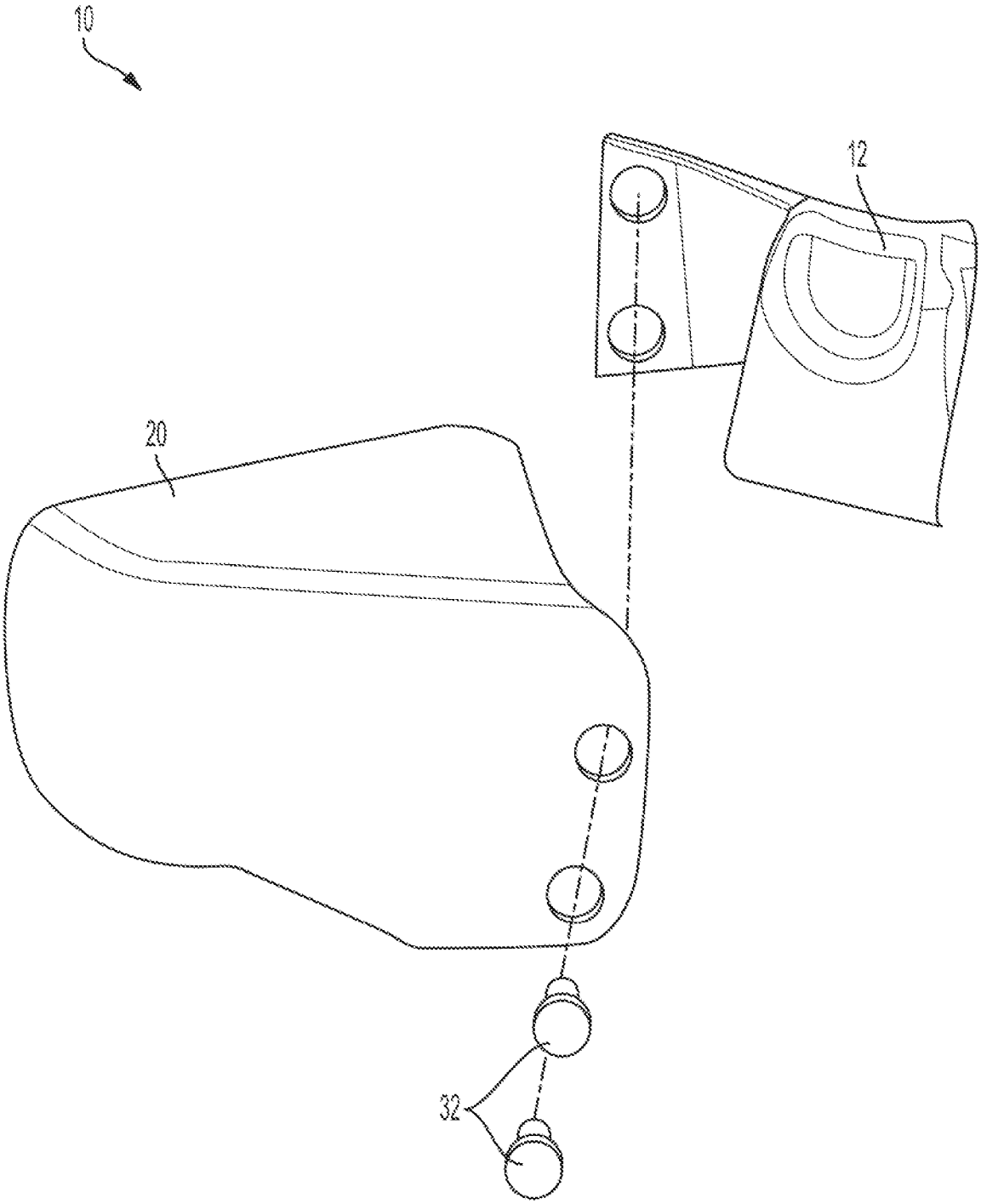
FIG. 3A is a partial exploded side view of an exemplary shoe donning apparatus.
Figure 3B:
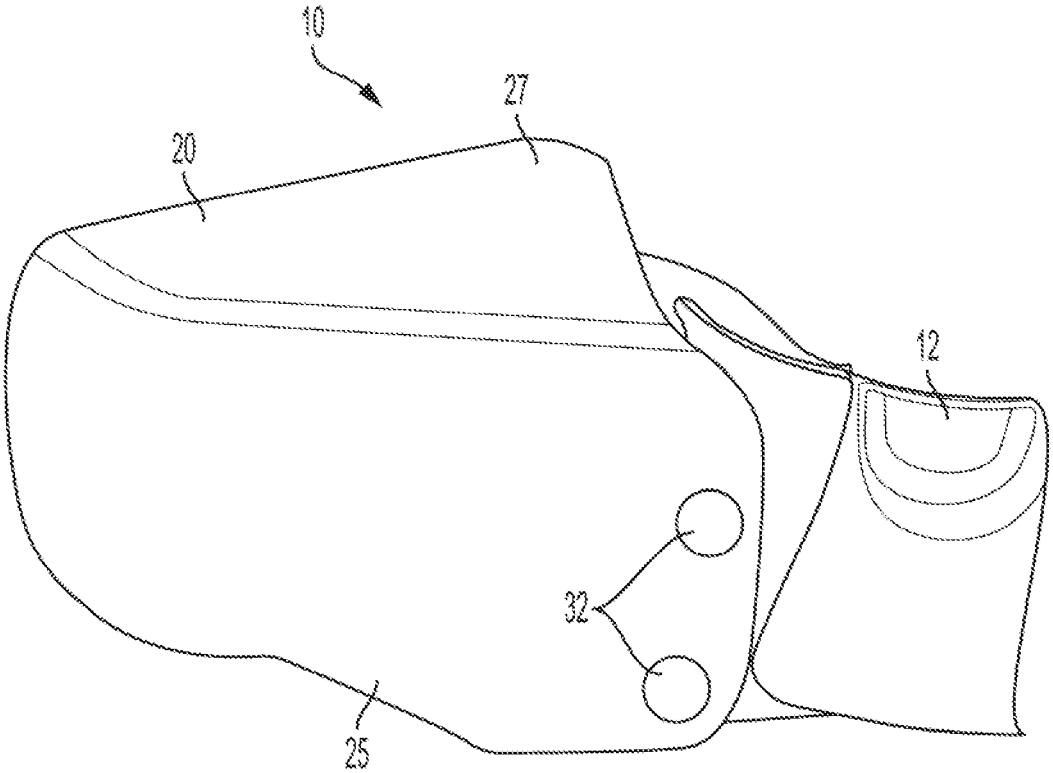
FIG. 3B is a partial side view of the exemplary shoe donning apparatus of FIG. 3A in an assembled configuration.

In some optional aspects, the first and second projections 20 can be coupled to the body 12 via fasteners 32 (e.g., rivets, as illustrated in FIGS. 3A-B) or adhesive. In further optional aspects and as illustrated in FIGS. 1-2, the first and second projections can be integrally formed with the body. For example, optionally, the body and the first and second projections can be formed as a single component (e.g., via injection molding) or bonded or welded together.

In some aspects, the apparatus 10 can be symmetric or substantially symmetric about a vertical longitudinally extending plane 30, wherein, when the apparatus 10 is positioned for use with the shoe 2 (e.g., with the body 12 resting on the heel collar and the first and second projections 20 beneath the tongue), it is contemplated that the plane 30 can longitudinally bisect or generally longitudinally bisect the shoe. In this way, the apparatus 10 can be usable for either a left shoe or a right shoe. In further aspects, the apparatus 10 can by asymmetric about the vertical longitudinally extending plane 30.

In some aspects, the apparatus can comprise a gripping element that is configured to engage an interior surface of the shoe 2 to inhibit movement of the apparatus with respect to the shoe as the user inserts her foot into the shoe. In some optional aspects, the gripping element can be a serrated edge 31 on a forward edge of the body 12 of the apparatus, an abrasive outer surface, a stepped edge that defines a hook for engaging a stitch or contour of the shoe, or any other element or surface treatment for inhibiting movement of the device in the shoe. In some aspects, it is contemplated that the interior of the shoe can include or be provided with a first fastener component, and the gripping element can comprise a second fastener component that is configured for complementary, releasable engagement with the first fastener component.

The body 12 can define one or more holes 34 (optionally through the top portion 14 of the body 12) that can receive a cord 36. Optionally, the body can define two holes, and the cord 36 can extend between the holes to define a loop, and ends of the cord 36 can be knotted (beneath the top portion 14 of the body 12) to inhibit removal from the holes 34. The cord 36 can be used to grip the apparatus to remove the apparatus from the shoe after the user has inserted a foot into the shoe. Although referred to herein as a "cord," it is contemplated that the cord 36 can include any elongate element that is capable of functioning as disclosed herein, such as, for example and without limitation, a cable or a strap. In further aspects, the body 12 can define tabs 38 that project outwardly from the body and can be gripped to assist with extracting the apparatus from the shoe. Optionally, the tabs 38 can define indentations 39 or other guides that receive and position the user's fingers (e.g., a thumb and forefinger) for gripping and squeezing the apparatus 10 for insertion into the shoe.

The body 12 of the apparatus 10 can comprise a resilient material. For example, in some aspects, the body 12 can comprise a polymer (e.g., a thermoplastic polymer). The body 12 can further define a slot 40 that can allow the apparatus 10 to flex for insertion into the shoe 2. The slot can be defined on the inner portion 16 of the body 12 between the first and second projections 20. In some aspects, the slot 40 can be centrally positioned so that it is intersected by the plane 30. Thus, it is contemplated that the body 12 can be symmetric or substantially symmetric about the plane 30. The slot 40 can be configured to permit relative movement between the first and second projections (e.g., so that their distal ends can be moved toward each other).

Figure 4:
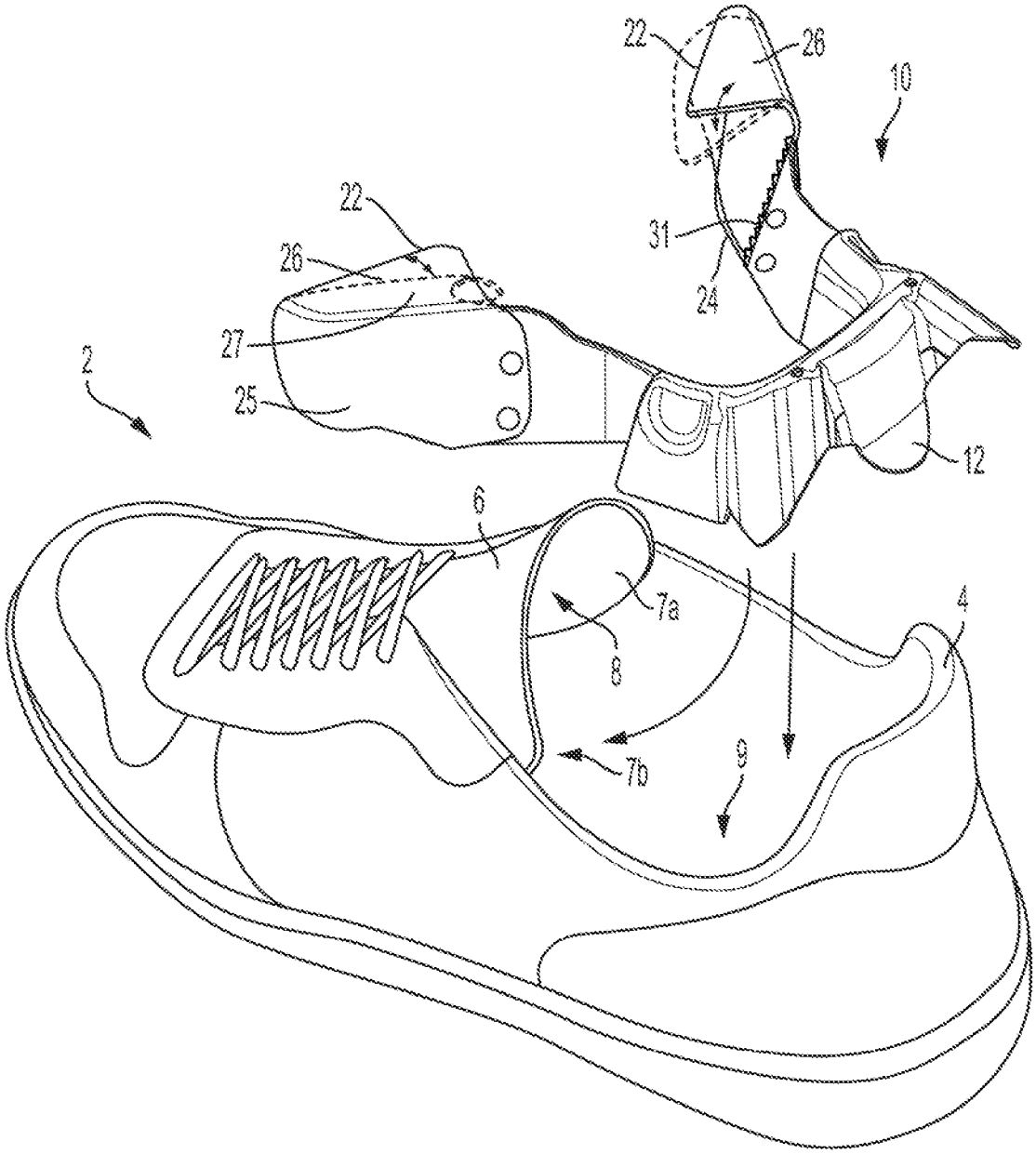
FIG. 4 is a schematic diagram illustrating use of an exemplary shoe donning apparatus.

In some optional aspects, and as shown in FIGS. 3A-4, the first and second projections 20 can define respective inner edges 22 that face a central vertical longitudinally extending plane 30. For example, the projections can each comprise a side portion 25 that biases against the respective inner side surface of the shoe 2 and top portions 27 extending inwardly from the side portions so that the top portions define the respective inner edges 22. The first and second projections 20 can further define lower edges 24 and upper surfaces 26. Optionally, the inner edges 22 can be concave in a respective direction 28*a*, 28*b* (FIG. 1) away from the central vertical longitudinally extending plane 30 (FIG. 1). In further aspects, the inner edges 22 can be straight or concave in the opposite direction (i.e., opposite of the respective directions 28*a*, 28*b*). In some optional aspects, the inner edges 22 of the first and second projections can be configured to resiliently deflect downwardly. For example, the inner edges 22 can be supported in a cantilevered fashion. In this way, the inner edges 22 of the projections can be folded downwardly (FIG. 4) as the apparatus 10 is inserted into the shoe and, when the inner edges 22 of the projections 20 are released from being folded downwardly, the inner edges 22 can resiliently move upwardly until respective upper surfaces 26 of the first and second projections 20 bias against the underside 8 of the shoe tongue 6. In some optional aspects, when inserted into the shoe, portions of the inner edges 22 of the first and second projections 20 can be closer to the plane 30 than forward-most portions of the body 12.

With reference to FIG. 1, it is contemplated that the first and second projections 20 can optionally have a forwardly extending length 106 of between 3 and 6 inches (optionally, about 4 inches) from the body 12.

With reference to FIGS. 3A-4, it is further contemplated that the first and second projections can have a dimension of about four inches along the surface that is perpendicular to the forwardly extending length and extends between the lower edge 24 and the inner edge 22 (optionally, along a vertical or substantially vertical axis). That is, along the surface of the projections, the lower edge 24 and the inner edge 22 can be spaced by about four inches, or less than four inches (e.g., from about one inch to about two inches, from about two inches to about three inches, or from about three inches to about four inches). More generally, it is contemplated that the forwardly extending length can be equal or substantially equal to the length along the surface that is perpendicular to the forwardly extending length.

In further optional aspects, and as shown in FIGS. 1-2, the first and second projections 20 can have upper edges 29 that oppose the lower edges 24, and the upper edges 29 can bias against the underside 8 of the tongue 6. In yet further optional aspects, the upper edges 29 can be folded inwardly and positioned below the tongue to thereby define the inner edges 22 (FIG. 4) that face the central vertical longitudinally extending plane 30. Accordingly, the outer surfaces 31 of the projections can form the upper surfaces 26 (FIG. 4) of the projections 20. In some aspects, the first and second projections 20 can have a height, from the lower edge 24 to the upper edge 29, of less than three inches (e.g., from about one inch to about two inches, or from about two inches to about three inches).

Referring to FIGS. 1-4, in some optional aspects, the top portion 14, inner portion 16, and outer portion 18 of the body 12 can define a U-shaped channel that receives at least an upper rear portion of the shoe 2 (e.g., the heel collar 4).

Figure 5:
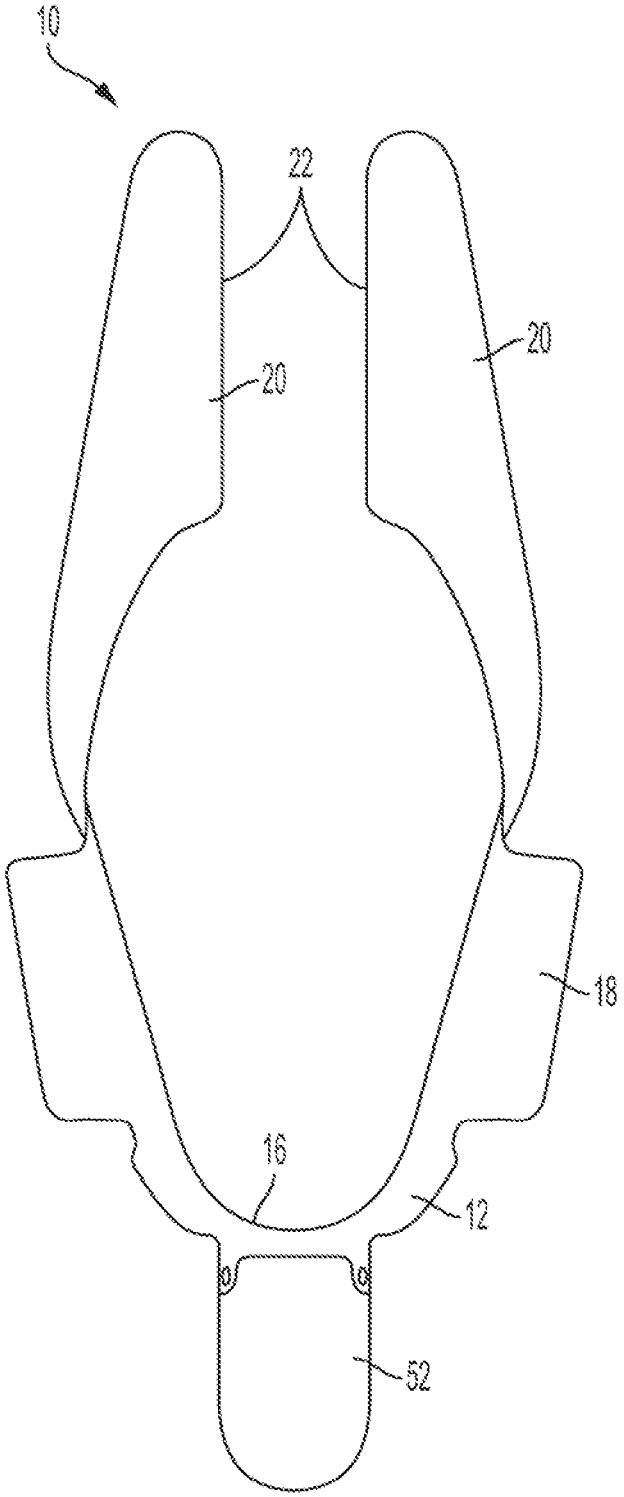
FIG. 5 is a top view of an exemplary shoe donning apparatus in accordance with embodiments disclosed herein.
Figure 6:
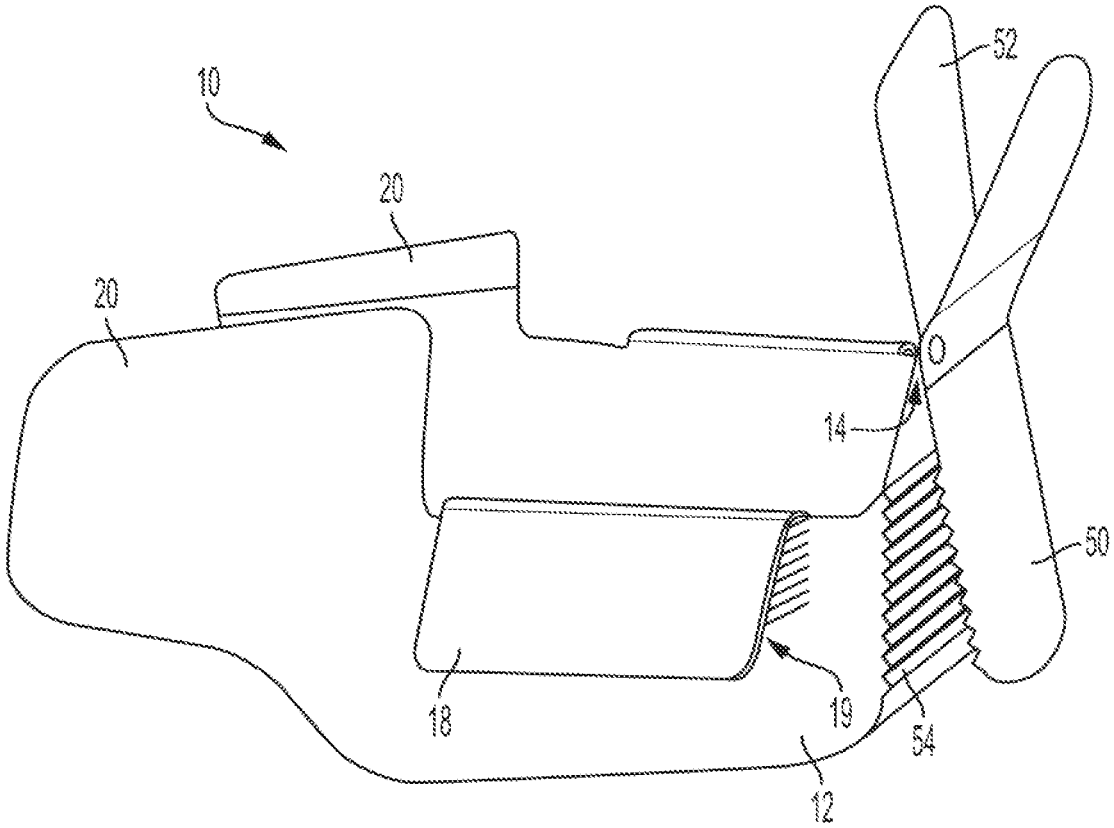
FIG. 6 is a side view of the shoe donning apparatus of FIG. 5.

In further optional aspects, and as shown in FIGS. 5-6, the apparatus 10 can comprise an inner portion 16 and one or more outer portions 18 that are positioned outwardly of the inner portion 16 to receive the shoe therebetween. For example, as shown, a pair of outer portions 18 can be positioned on each side of the apparatus 10. The inner portion 16 and outer portions 18 can cooperate to define respective channels 19 that can receive upper portions of the shoe that define the opening 9.

Referring to FIGS. 5 and 6, in some optional aspects, the apparatus 10 can comprise a clip 50 that is pivotably attached or coupled to the body 12 and spring-biased toward the inner portion 16 of the body 12. The clip 50 can grip the heel portion of the heel collar to affix the apparatus 10 to the shoe. The clip 50 can define a lever end 52 that can enable the user to open the clip to insert the shoe between the body and the clip and to release the clip from the shoe. In some aspects, at least one of the clip 50 and the inner portion 16 of the body (optionally, both the clip 50 and an outwardly facing surface of the inner portion 16 of the body) can define a texture 54 (i.e., gripping surface) for gripping the shoe. In some aspects, the clip 50 can define a top portion 14 of the body 50 that overlies the heel collar 4.

Referring to FIGS. 1-6, to use the apparatus, a user (or a care professional assisting the user) can loosen the shoelaces (or other fastener for the shoe) to prepare the shoe for receiving a foot of the user. The user can squeeze the outer edges of the device 10 so that the distal ends of the first and second projections 20 can be inserted into and accommodated within the opening of the shoe. Optionally, the upper surfaces of one or both of the projections 20 can be folded downwardly so that the first and second projections can be received within the shoe beneath the tongue 6. The device can then be inserted into the shoe until the body is partially received into the shoe and the top portion 14 of the body 12 rests against the heel collar. The projections 20 (e.g., the upper surfaces 26 and/or the upper edges 29 of the first and second projections 20) can bias upwardly against the underside 8 of the tongue 6 of the shoe so that the opening 9 of the shoe 2 is held in an open configuration. For example, in some aspects, the first and second projections 20 can be inserted into the shoe, and the forward end of the apparatus 10 can be pivoted upwardly until the first and second projections 20 bias against the tongue 6 of the shoe 2. In further aspects, the apparatus 10 can be positioned so that the first and second projections 20 are beneath the tongue, and the tongue can be placed onto the first and second projections.

Once the apparatus 10 is positioned to retain the tongue of the shoe 2 in the open configuration, the shoe can be placed on the floor or other surface. The user can insert a foot into the shoe. During insertion of the toot into the shoe, the first and second projections 20 can retain the tongue in a raised position, which can be particularly beneficial for users who cannot see or hold the tongue while inserting a foot into the shoe. The user can then remove the apparatus 10 from the shoe (e.g., by pulling on the cord 36 or a tab as disclosed herein).

Optionally, the apparatus 10 can be customized for use with a specific user and/or a specific shoe (i.e., the apparatus 10 can have a customized shape that accounts for the specific geometry of the foot of the user and/or the shoe to be worn by the user). For example, in some aspects, a distal portion 33 of at least one of the first and second projections can be removed to reduce the longitudinal length of said projection (s). In further aspects, an inner portion of at least one of the first and second projections can be removed. In still further optional aspects, a lower portion of at least one of the first and second projections can be removed to allow the lower edge to avoid interference with the arch of a shoe.

Individuals with loss of feeling in their feet may not know they have their foot jammed into a shoe with the tongue bunched up at the end of their toes. It is contemplated that the disclosed apparatus and methods can prevent such bunching of the tongue and, accordingly, prevent or reduce the risk of blisters and sores that are difficult to heal and present an increased risk of infection.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: An apparatus for assisting a user in donning a shoe, the shoe having a heel collar and a tongue, wherein the tongue has an underside, the apparatus comprising: a body that is partially receivable into the shoe, the body having: a top portion that is configured to extend above the heel collar when the body is partially received into the shoe; and an inner portion extending downwardly from the top portion; and first and second projections that extend forwardly from the body and are configured to bias against the underside of the tongue on opposing sides of the tongue.

Aspect 2: The apparatus of aspect 1, wherein the body further comprises an outer portion extending downwardly from the top portion, wherein the body is configured to receive the heel collar between the inner portion and the outer portion.

Aspect 3: The apparatus of aspect 1 or aspect 2, wherein the body is generally U-shaped.

Aspect 4: The apparatus of any one of the preceding aspects, wherein the first and second projections define respective inner edges that face a central vertical longitudinally extending plane, wherein the inner edges are configured to resiliently deflect downwardly.

Aspect 5: The apparatus of any one of the preceding aspects, wherein the first and second projections are integrally formed with the body as a monolithic structure.

Aspect 6: The apparatus of any one of aspects 1-4, wherein the first and second projections are each coupled to the body with at least one fastener.

Aspect 7: The apparatus of any one of the preceding aspects, wherein the apparatus is symmetric about a central vertical longitudinally extending plane that bisects the apparatus.

Aspect 8: The apparatus of any one of aspects 1-6, wherein the apparatus is asymmetric about a central vertical longitudinally extending plane that bisects the apparatus.

Aspect 9: The apparatus of any one of the preceding aspects, where each of the first and second projections defines a concave upper surface.

Aspect 10: The apparatus of any one of the preceding aspects, wherein at least one of the first and second projections defines an inner edge that faces a central vertical longitudinally extending plane, wherein at least a portion of the inner edge is concave in a direction away from the central vertical longitudinally extending plane.

Aspect 11: The apparatus of any one of the preceding aspects, further comprising a gripping element that is configured to engage an interior surface of the shoe to inhibit movement of the apparatus with respect to the shoe.

Aspect 12: The apparatus of aspect 11, wherein the gripping element comprises an abrasive surface.

Aspect 13: The apparatus of aspect 11, wherein the body has a forward edge, and wherein the gripping element comprises serrations on the forward edge.

Aspect 14: The apparatus of any one of the preceding aspects, wherein the body comprises a resilient material.

Aspect 15: The apparatus as in any one of the preceding aspects, wherein the first and second projections are generally parallel.

Aspect 16: The apparatus of any one of aspects 2-15, wherein the inner and outer portions slope away from each other in a direction away from the top portion.

Aspect 17: A method of using the apparatus as in any one of the preceding aspects with the shoe, the method comprising: inserting at least a portion of the apparatus into the shoe so that the first and second projecting portions bias against the underside of the tongue; and positioning the body so that the heel collar is received between the outer portion and the inner portion of the body.

Aspect 18: The method of aspect 17, further comprising: inserting a foot into the shoe; and removing the apparatus from the shoe.

Aspect 19: A method of customizing the apparatus as in any one of aspects 1-16, the method comprising removing a portion of at least one of the first and second projections.

Aspect 20: The method of aspect 19, wherein removing the portion of the at least one of the first and second projections comprises removing an inner portion of one of the first and second projections that opposes the other of the first and second projections.

Aspect 21: The method of aspect 20, wherein removing the portion of the at least one of the first and second projections comprises removing a distal portion of the at least one of the first and second projections to reduce a longitudinal length of the at least one of the first and second projections.

Although several embodiments of the invention have been disclosed in the foregoing specification and the following appendices, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. An apparatus for assisting a user in donning a shoe, the shoe having a heel collar and a tongue, wherein the tongue has an underside, the apparatus comprising:

a body that is partially receivable into the shoe, the body having:

a top portion that is configured to extend above the heel collar when the body is partially received into the shoe; and an inner portion extending downwardly from the top portion; and first and second projections that extend forwardly from the body and are configured to bias against the underside of the tongue on opposing sides of the tongue, wherein the body and the first and second projections are integrally formed as a monolithic structure, and wherein the first and second projections extend forwardly at least five inches from a rearmost point of the top portion of the body, and wherein each of the first and second projections has a proximal portion and a distal portion, wherein each of the first and second projections has an upper edge cooperatively defined by the proximal portion and the distal portion, wherein a portion of the upper edge defined by the proximal portion is vertically spaced from a portion of the upper edge defined by the distal portion.

2. The apparatus of claim 1, wherein the body further comprises an outer portion extending downwardly from the top portion, wherein the body is configured to receive the heel collar between the inner portion and the outer portion.

3. The apparatus of claim 2, wherein the inner and outer portions of the body slope away from each other in a direction away from the top portion of the body.

4. The apparatus of claim 1, wherein the body is generally U-shaped.

5. The apparatus of claim 1, wherein the first and second projections define respective inner edges that face a central vertical longitudinally extending plane, wherein the inner edges are configured to resiliently deflect downwardly.

6. The apparatus claim 1, wherein the apparatus is symmetric about a central vertical longitudinally extending plane that bisects the apparatus.

7. The apparatus of claim 1, where the upper edge of each of the first and second projections is configured to bias against the underside of the tongue of the shoe.

8. The apparatus of claim 1, wherein a central vertical longitudinally extending plane bisects the apparatus, wherein at least one of the first and second projections defines an inner edge that faces the central vertical longitudinally extending plane, wherein at least a portion of the inner edge is concave in a direction away from the central vertical longitudinally extending plane.

9. The apparatus of claim 1, further comprising a gripping element that is configured to engage an interior surface of the shoe to inhibit movement of the apparatus with respect to the shoe, wherein each of the first and second projections has a distal end, wherein the gripping element is proximal of the distal end of each of the first and second projections.

10. The apparatus of claim 9, wherein the gripping element comprises an abrasive surface, or wherein the body has a forward edge, and wherein the gripping element comprises serrations on the forward edge.

11. The apparatus of claim 1, wherein the body comprises a resilient material.

12. The apparatus of claim 1, wherein the first and second projections are generally parallel.

13. The apparatus of claim 1, wherein the body and the first and second projections are formed as a single component via injection molding.

14. A method of using the apparatus as in claim 1 with the shoe, the method comprising:

inserting at least a portion of the apparatus into the shoe so that the first and second projecting portions bias against the underside of the tongue; and positioning the body so that the heel collar is received between the outer portion and the inner portion of the body.

15. The method of claim 14, further comprising:

inserting a foot into the shoe; and removing the apparatus from the shoe.

16. The method of claim 15, further comprising removing, by cutting from a remainder of the apparatus, a first portion of at least one of the first and second projections to customize a shape of the apparatus prior to inserting the at least a portion of the apparatus into the shoe.

17. The method of claim 16, wherein removing the first portion of the at least one of the first and second projections comprises removing an inner portion of one of the first and second projections that opposes the other of the first and second projections.

18. An apparatus for assisting a user in donning a shoe, the shoe having a heel collar and a tongue, wherein the tongue has an underside, the apparatus comprising:

a body that is partially receivable into the shoe, the body having:

a top portion that is configured to extend above the heel collar when the body is partially received into the shoe; and an inner portion extending downwardly from the top portion; and first and second projections that extend forwardly from the body and are configured to bias against the underside of the tongue on opposing sides of the tongue, wherein the body and the first and second projections are integrally formed as a monolithic structure, and wherein the first and second projections extend forwardly at least five inches from a rearmost point of the top portion of the body, wherein each of the first and second projections has a lower edge and an upper edge, wherein the upper edge of each of the first and second projections comprises a first portion that is spaced from the lower edge by a first distance and a second portion that is spaced from the lower edge by a second distance that is greater than the first distance, wherein the second portion is distal of the first portion.

* * * * *